US006568730B1

(12) United States Patent
Paterson

(10) Patent No.: US 6,568,730 B1
(45) Date of Patent: May 27, 2003

(54) OBJECT HANDLING DEVICE FOR LIFTING OF PRECAST BODIES SUCH AS CONCRETE PANELS

(76) Inventor: Ian Alexander Paterson, 4 Saville Street, Ferny Creek, Victoria 3786 (AU)

( * ) Notice: Subject to any disclaimer, the term of this patent is extended or adjusted under 35 U.S.C. 154(b) by 0 days.

(21) Appl. No.: 09/674,553

(22) PCT Filed: May 4, 1999

(86) PCT No.: PCT/AU99/00331

§ 371 (c)(1),
(2), (4) Date: Nov. 2, 2000

(87) PCT Pub. No.: WO99/57055

PCT Pub. Date: Nov. 11, 1999

(30) Foreign Application Priority Data

May 4, 1998 (AU) ..... PP 3304

(51) Int. Cl.[7] ..... B66C 1/66
(52) U.S. Cl. ..... 294/89; 52/125.5; 52/707
(58) Field of Search ..... 294/67.32, 81.52, 294/81.53, 82.24, 89, 93, 94; 52/125.1, 125.4, 125.5, 704, 707, 708, 711

(56) References Cited

U.S. PATENT DOCUMENTS

| | | | | |
|---|---|---|---|---|
| 4,139,228 A | * | 2/1979 | Varadi | 294/81.53 X |
| 4,179,151 A | * | 12/1979 | Tye | 294/89 |
| 4,325,575 A | * | 4/1982 | Holt et al. | 294/89 |

FOREIGN PATENT DOCUMENTS

| | | | | |
|---|---|---|---|---|
| DE | 160626 | * | 12/1983 | 294/89 |
| DE | 240185 | * | 10/1986 | 294/89 |
| DE | 3838487 | * | 2/1990 | 294/89 |
| FR | 2504900 | * | 11/1982 | 294/89 |

* cited by examiner

*Primary Examiner*—Dean J. Kramer
(74) *Attorney, Agent, or Firm*—Sterne, Kessler, Goldstein & Fox, P.L.L.C.

(57) ABSTRACT

An object handling device including a support body, and an elongate anchor body, having a proximal end, a distal end and a longitudinal dimension extending between the proximal and distal ends, the body is mounted at the inner proximal end thereof to the support body so as to project from the support body for insertion into an undercut cavity extending into an object from an edge or face of the object to be handled. At least one anchor lug at or adjacent to the outer distal end of the anchor body movable by rotation of the anchor body between a first position in which the anchor body is able to be inserted into or withdrawn from the cavity, and a second position in which at least one anchor lug engages a respective undercut shoulder portion in the cavity. Lever arm on the anchor body is engagable for moving the anchor body to move the at least one anchor lug between the first and second positions. A lift bar on the support body engagable by a crane to lift the object. A lock is responsive to the lift bar to block movement of at least one anchor lug from the second position. In one aspect, the anchor body is rotatable to effect the movement of at least one anchor lug. In another, the lock is slidable generally longitudinally of the anchor body to a blocking position in which movement of at least one anchor lug from the second position is blocked. In a further aspect, there is substantially no cavity or void in the object within a region outwards of the undercut shoulder portions sufficient to allow collapse or flow of the object material when the object is being lifted. Also disclosed is a form for defining an undercut cavity in a precast object.

52 Claims, 15 Drawing Sheets

OBJECT HANDLING DEVICE FOR LIFTING OF PRECAST BODIES SUCH AS CONCRETE PANELS

FIELD OF THE INVENTION

This invention relates generally to the handling of objects such as, for example, precast concrete panels. The invention has particular though certainly not exclusive application to facelift and edgelift systems for handling large precast building elements, such as concrete panels, in the construction industry.

BACKGROUND ART

It is now widespread practice to construct various kinds of buildings, but especially commercial and industrial buildings, by on site erection and assembly of structural concrete panels which are either precast on site and tilted into position, or precast elsewhere and brought to the site In the latter case, the panels are normally cast flat, lifted to the vertical, and then transported while substantially vertical and lifted into position on site.

It is of course imperative in the handling of these large structural panels as they are tilted, transported and moved into position that there be no risk whatever that they will fall. An established system for handling the panels involves an anchor cast in the panel and a clutch assembly by which a crane sling may be secured to the anchor. The anchor normally includes a head within the concrete body and an end which remains below the face or edge of the panel but is exposed within a recess. The clutch engages the anchor within this recess and is arranged so that the clutch cannot disengage while the panel is in a partially or wholly tilted orientation. One such arrangement is disclosed in U.S. Pat. No. 3,883,170 and is the basis of the commercial Frimeda system. Another approach is described in Australian patent 544832.

While these systems with an embedded anchor and safety clutch assembly have proven satisfactory in practice, they do have a significant disadvantage in that the steel anchors remain embedded in the panel in the erected building. In time, even though the original recess is capped or filled with mortar, the embedded steel anchor is a source of corrosion and can lead to discolouring in walls formed from the panels. There is also the economic issue that a relatively heavy steel component is essentially only used once and is in effect discarded because it cannot be practically recovered for reuse.

Any improved panel handling system should preferably be adaptable to both facelift and edgelift systems.

There have been at least two attempts to address these issues by providing a substantially plastic component in the panel. Australian patent 488954 proposes an arrangement in which the anchor component comprises a steel nut contained in an undercut enlargement at the end of a plastic tube cast in situ, and a threaded eyebolt is projected down the tube and attached to the nut for lifting. The steel component is much smaller, but this system has the significant disadvantage of the time required to screw and unscrew the eyebolt. In a somewhat similar approach described in Australian patent application 89982/91, a flat steel rectangular block is provided in an undercut enlargement in a rectangular plastic tube, and a pair of clutch shafts are inserted into the hole deformed by the tube. The shafts have end lugs which engage under the block and the system is locked by pushing in a secondary pin between the shafts to forcibly separate them. This system has been viewed as unsafe for transporting heavy building elements because of the risk of operator error in failing to insert the locking pin.

German patent application 195 23 476 discloses an arrangement in which an anchor body is rotatable to bring a pair of lugs beneath undercuts in a lined cavity, and then locked against return rotation by turning down a notched flap to engage the crane lift bar. Longitudinal voids are provided in the concrete for the passage of the crosshead extensions and lugs during insertion. These voids remain empty during lifting operations, and are a potential source of weakness as they could allow concrete to break away and flow into them. The rotatable load bearing element is a tube, and there is a cross-head spaced from the inner end of the cavity. This system requires, on attachment, four separate manual operations, ie. insertion, rotation, locking and crane hook engagement, and, on detachment, each of these four steps in reverse. Remote release is not an available option.

SUMMARY OF THE INVENTION

The present invention proposes four improvements which may be used separately but are preferably used in conjunction, and which are suited to use with an undercut plastic tube former of appropriate profile. One of these improvements is to provide for engagement by way of a limited rotating action, another to provide safety by linear motion of a positively blocking element responsive to the position of the lifting tackle, a third involves proper control of voids and cavities to prevent failure by collapse or flow of material, and a fourth entails a novel configuration of relatively rotatable and non-rotatable elements.

In a first aspect, the invention accordingly provides an object handling device including a support body, and an elongate anchor body mounted at the inner end thereof to the support body so as to project from the support body for insertion into an undercut cavity in an object to be handled and so as to be rotatable about an axis generally parallel to the longitudinal dimension of the anchor body. At least one anchor lug at or adjacent to the outer end of the anchor body is movable by rotation of the anchor body between a first position in which the anchor body is able to be inserted into or withdrawn from the cavity, and a second position in which the lug(s) engage respective undercut shoulder portions in the cavity. Means on the anchor body is engagable for rotating the anchor body to move the anchor lug(s) between the first and second positions. Lift means on the support body is engagable by a crane to lift the object.

Preferably, lock means is responsive to the lift means to block movement of the anchor lug(s) from the second position.

In a second aspect, the invention provides an object handling device including a support body, and elongate anchor body means mounted at an inner end thereof to the support body so as to project from the support body for insertion into an undercut cavity in an object to be handled. At least one anchor lug at or adjacent the outer end of the anchor body means is moveable with the anchor body means between a first position in which the anchor body means is able to be inserted into or withdrawn from the cavity, and a second position in which the lug(s) engage respective undercut shoulder portions in the cavity. Means on the anchor body is engagable for moving the anchor lug(s) between the first and second positions. Lock means is slidable generally longitudinally of the anchor body means to a blocking position in which movement of the anchor lug(s) from the second position is blocked. Lift means carried by the support body is engagable by a crane to lift the object, and means is responsive to the lift means to activate the lock means to slide it to the blocking position.

In a third aspect, the invention provides an object handling device including a support body, and elongate anchor body means mounted at an inner end thereof to the support body so as to project from the support body for insertion into an undercut cavity in an object to be handled. At least one anchor lug at or adjacent the outer end of the anchor body means is moveable with the anchor body means between a first position in which the anchor body means is able to be inserted into or withdrawn from the cavity, and a second position in which the lug(s) engage respective undercut shoulder portions in the cavity. Means on said anchor body is engagable for moving the anchor lug(s) between the first and second positions. Lift means on the support body is engagable by a crane to lift the object, and lock means is responsive to the lift means to block movement of the anchor lug(s) from the second position. In this third aspect, the device is shaped and configured for said insertion so that, when the anchor lug(s) are in said second position, there is substantially no cavity or void in the object within a region outwards of the undercut shoulder portions sufficient to allow collapse or flow of the object material when the object is being lifted.

The invention still further provides an object handling device including a support body, and an elongate anchor body mounted at the inner end thereof to the support body so as to project from the support body for insertion into an undercut cavity in an object to be handled and so as to be rotatable about an axis generally parallel to the longitudinal dimension of the anchor body. At least one anchor lug at or adjacent to the outer end of the anchor body is movable by rotation of the anchor body between a first position in which the anchor body is able to be inserted into or withdrawn from the cavity, and a second position in which the lug(s) engage respective undercut shoulder portions in the cavity. Means on the anchor body is engagable for rotating the anchor body to move the anchor lug(s) between the first and second positions, and lift means on the support body is engageable by a crane to lift the object.The lift means is rotatably mounted with respect to the support body and is thereby rotationally alignable with the direction of load.

In a fifth aspect, the invention is directed to an object handling device embodying the features of two or more of the first, second, third and fourth aspects of the invention.

Preferably, the lock means is a plurality of elongate shafts or pins of cross section similar to and matching the cross section of the respective lugs in a plane normal to the axis. By this arrangement, the lugs are aligned with the lock shafts or pins during insertion or withdrawal of the device, and move out of alignment in the second position, whereupon the lock rods slide into the vacated space and thereby block movement of the lugs back to the first position.

Preferably, the elongate anchor body is generally cylindrical and the lugs and lock rods exhibit dovetail or part annular profiles to opposite sides of the anchor body as viewed in cross section. In one embodiment, particularly suited to edgelift systems, the angular extent of the lugs about said axis is about 60° so that the lugs occupy adjacent 60° sectors in the respective first and second positions. Alternatively, and more suitably for facelift systems, the lugs sub-tend about 90° at the axis of the anchor body and thereby occupy respective 90° sectors in their first and second positions.

Said means engagable for moving the anchor body lugs preferably includes a manipulable handle carried by the support body.on the side opposite that from which the anchor body extends.

The lift means is preferably a solid component rotatably carried by the support body for movement between a first position in which the lock means does not block the anchor body lug(s) and a range of rotational positions in which it does. The responsive means is preferably a cam and cam follower arrangement by which the lift means and lock means are engaged in a co-operative relationship. According to the exact nature of the lift system in use, the aforementioned first position for the lift means will be that in which the object being handled is at rest, not elevated, and has with no lifting tension applied to the lift means, while any other position of the lift means will cause activation of the lock means to block the anchor lugs.

Preferably, means is provided to bias the lock means to a position in which it does not block movement of the anchor lugs. Preferably also, means is provided to bias the support body of the lift device clear of the object surface about the cavity unless it is pushed into the cavity and the anchor lugs engaged.

In a sixth aspect, the invention provides a form for defining an undercut cavity in a pre-cast object, said form being in a plastics and/or polymer material or a thin gauge metal, wherein the form includes a first portion defining an elongate passage of substantially uniform cross section including a core portion and respective laterally projecting portions of a predetermined profile, and a pair of undercut portions of cross section geometrically similar to said side portions and disposed adjacent to the respective side portions.

A preferred handling, eg lifting, system according to the invention includes a handling device according to the first, second, third and fourth aspects of the invention and a cavity form according to the sixth aspect.

BRIEF DESCRIPTION OF THE DRAWINGS

The invention will now be further described, by way of example only, with reference to the accompanying drawings, in which.

PREFERRED EMBODIMENTS

Figure 1:
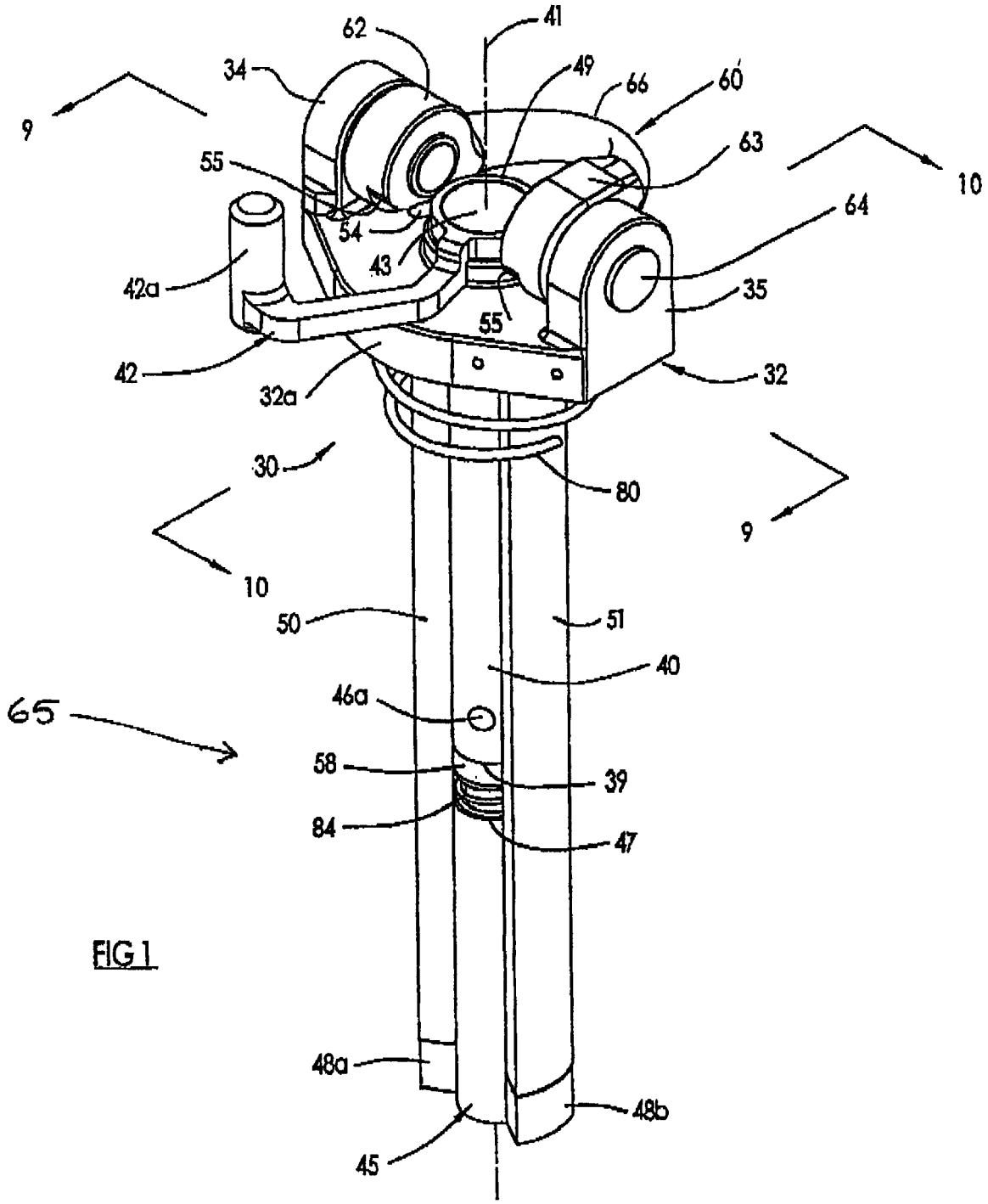
FIG. 1 is an isometric view of a lift device or clutch according to an embodiment of the invention, but suitable for edgelift systems.

The drawings illustrate an edgelift system for handling precast concrete panels. The principal elements include a cavity 22 (FIG. 4) defined by a plastics form 25 (FIGS. 2 and 3) in an edge 21 of a precast concrete structural panel 20, and a lift device 30 (FIG. 1) which is engagable with cavity 22 and with the lifting tackle of a crane.

The panel would typically be cast flat and form 25 supported in situ for defining cavity 22. In some cases, the panel would be cast on site and the lifting system is required to simply tilt the panel to position. In other cases, panels of this kind are formed at a casting plant, tilted to a vertical orientation, and then transported by truck in this orientation to the construction site where they are further handled into position.

By analogy with conventional edgelift and facelift systems, lift device 30 will hereinafter be referred to as a clutch-anchor, and cavity 22 with its defining form 25 as insert 24. A conventional shear bar 99 (FIG. 4) is clipped to the outer end of form 25 and extends parallel to the edge face of the concrete panel, below its surface.

With particular reference to FIG. 1, clutch-anchor 30 includes a support body in the form of a cast metal swash plate 32, a depending anchor shaft 40 rotatably mounted to swash plate 32, a pair of lock rods 50, 51 extending parallel to shaft 40, a lever arm 42 for rotating shaft 40, and a lift bar 60 for attaching clutch-anchor 30 to crane tackle.

Swash plate 32 has an enlarged central region with arcuate side faces 32*a* from which it tapers to upstanding end posts 34, 35 in which lift bar 60 is rotatably supported in a trunnion bearing arrangement. At the centre of swash plate 32 is an aperture 33 (FIGS. 9–12) from which shaft 40 is rotatably supported by a bolt 43. Bolt 43 projects downwardly through aperture 33 and engages a coaxial threaded blind bore 44*a* in the upper end of shaft 40. A transverse locking pin 43*a* ensures the mounting. The lower end of shaft 40 also has a coaxial threaded blind bore 44*b* to receive a threaded reduced diameter spigot portion 46 of an anchor head 45. A transverse locking pin 46*a* is again used to ensure the mounting, and the annular shoulder 47 defined by spigot portion 46 is spaced from the end of anchor shaft 40 to define an annular gap 39 for a purpose to be further explained.

The outer end of anchor head 45 has a cylindrical periphery flush with that of anchor shaft 40 save for a pair of laterally projecting anchor lugs 48*a*, 48*b*. These lugs are of dovetail shape, have an outer arcuate face coaxial with anchor shaft 40 and radial end faces so that the lugs subtend an angle of 60° at the axis 41 of shaft 40. Anchor shaft 40 is rotatable about axis 41 by hand manipulation of lever arm 42. Lever arm 42 is an integral piece having a ring 49 fixed to the head of bolt 43 above swash plate 32 and is moveable through 60° (for reasons which will become apparent) between an exposed position in which the lever arm projects generally laterally outwardly of the axis linking posts 34, 35, and a nested position (FIG. 4) in which the shallow U-shaped lever arm tucks around post 34. In this latter position, the anchor lugs 48*a*, 48*b* have rotated through 60° just out of their previous position to the immediately adjacent 60° sector with respect to axis 41.

The lock rods 50, 51 are machined or cast solid metal of uniform cross section save for their upper ends. Their cross sectional profile is substantially identical to anchor lugs 48*a*, 48*b*, ie a dovetail shape with an outer arcuate surface coaxial with axis 41 and radial end faces so that the cross section subtends an angle of 60° at axis 41. Lock rods 50, 51 are held in matching apertures 59 (FIG. 9) in swash plate 32 and have end bosses 53 at these inner ends. Respective pins 54 are upstanding from bosses 53 and serve as cam followers with respect to eccentric cam tracks 55 on lift bar 60.

By analogy with conventional edgelift and facelift systems, shaft 40, head 45 and lock rods 50, 51 may collectively be referred to as anchor 65.

Lift bar 60 is an integral machined or cast metal component. It includes a pair of end blocks 62, 63 for retaining trunnions 64 rotatably engaged with posts 34, 35, and a bridging portion 66 that curves over from one end block to the other and is of generally circular or elliptical cross section.

Figure 2:
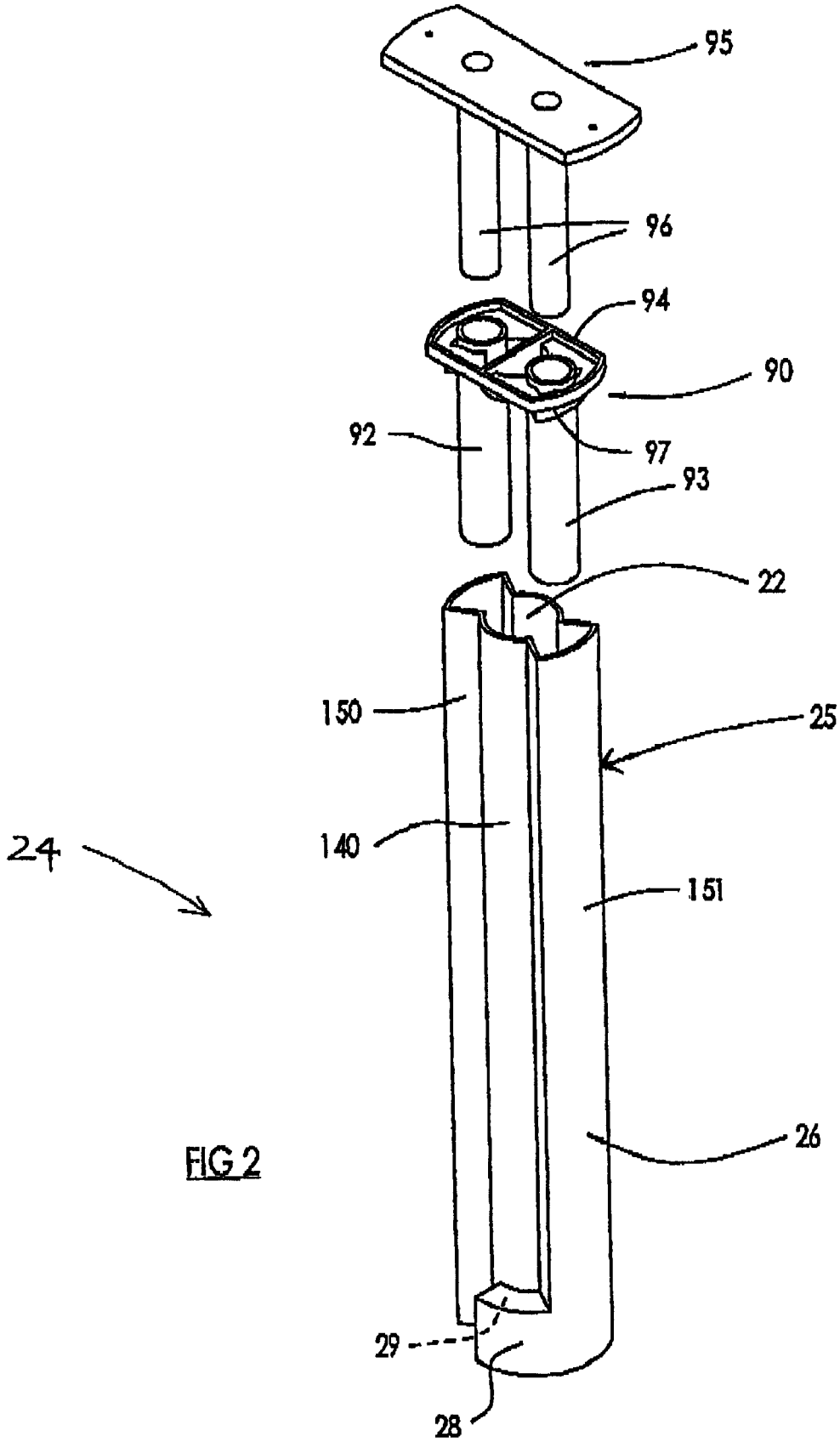
FIG. 2 is a three dimensional view of a form of a plastics material, suitable for edgelift systems, for defining an insert in a precast concrete panel, shown with a cap for the resultant cavity and a formwork location plug.
Figure 3:
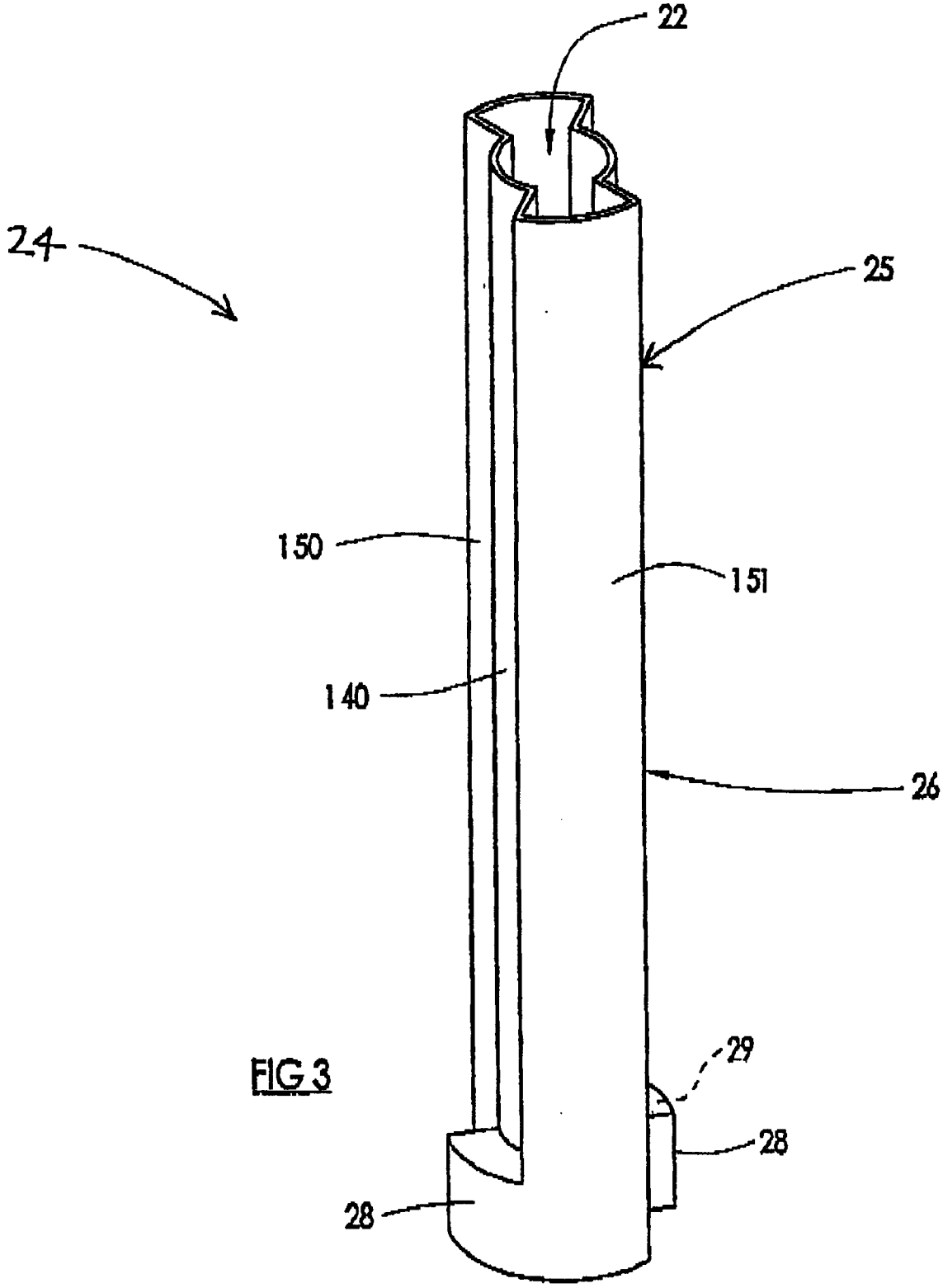
FIG. 3 is a view similar to FIG. 2 of the form, but at a different angle.

Before describing the operation of the edgelift system, attention will now be turned to the insert 24. Referring in particular to FIGS. 2 and 3, form 25 and cavity 22 include an elongate main portion 26 of uniform cross section profiled to receive the cross section (normal to axis 41) defined by shaft 40 and lock rods 50, 51 of anchor 65, ie a cylindrical centre 140 and a pair of oppositely projecting dovetails 150, 151. The form 25 and cavity 22 further define an undercut portion 28 of cross section (normal to axis 41) substantially identical to the dovetail for receiving rod 50 or 51: this undercut 28 opens at one end at the side of a respective dovetail and defines an undercut shoulder 29. A cap 90 is provided to prevent entry of wet concrete and dust and comprises a pair of blind tubes 92, 93 depending from a cover plate 94. Tubes 92, 93 engage the dovetails 150, 151 in an interference fit, while cover plate 94 has an underside outstanding formation 97 to register with the internal cross-section of form main portion 26. Tubes 92, 93 are open at cover plate 94 to receive tubular location pins 96 of a formwork plug 95 used to locate and retain the form during casting, by being attached to a supporting formwork.

The interior of form 25 may be slightly longitudinally tapered, larger at the outer end and for example by 2–3 mm over the length of the form, to facilitate disengagement of device 30.

Figure 13:
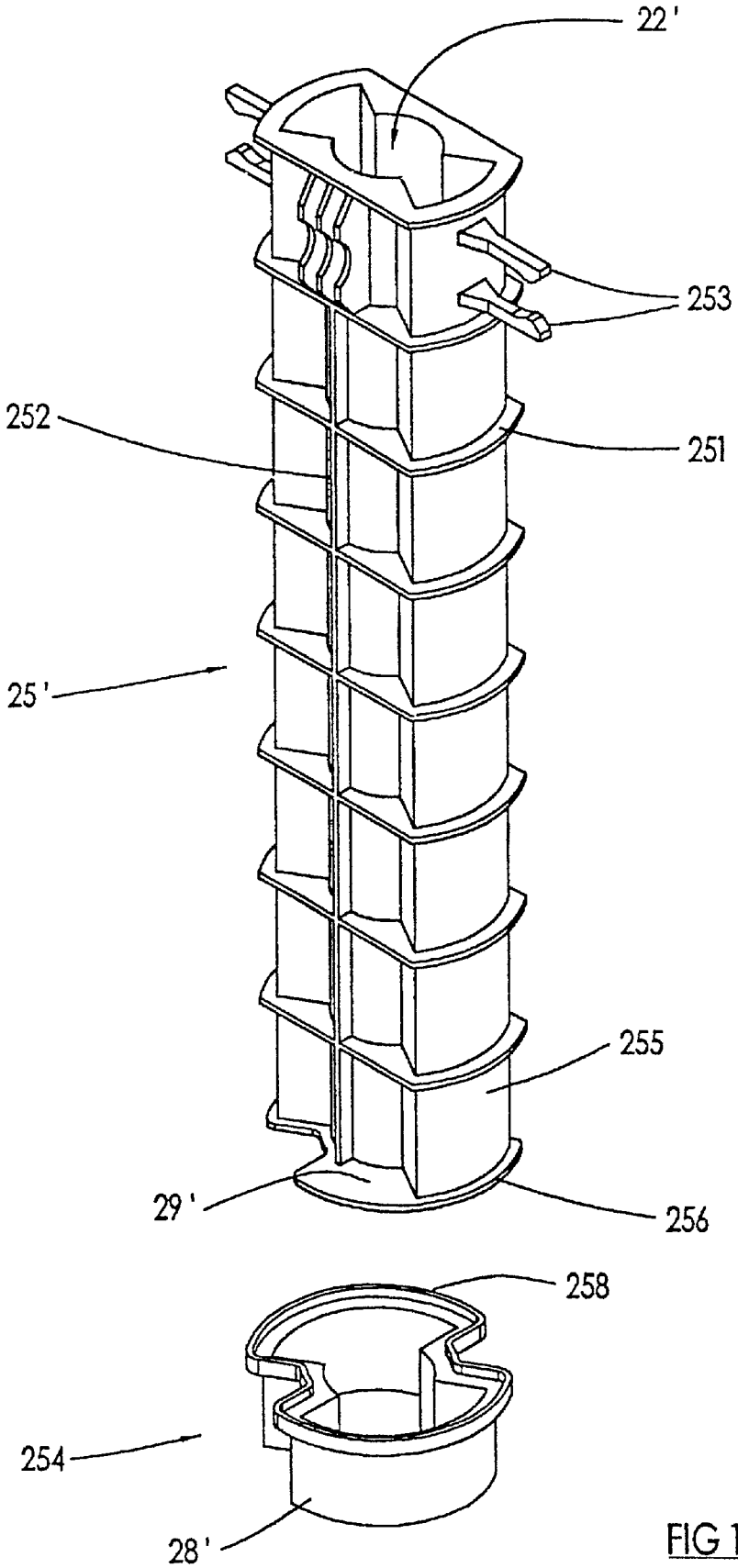
FIG. 13 is a view of a modification of the form shown in FIGS. 2 and 3.

A modified form 25' is depicted in FIG. 13. The form is generally similar to that of FIGS. 2 and 3, but has spaced annular ribs 251 and longitudinal ribs 252 on each side for enhanced strength. Deflectable pairs of lugs 253 are provided to act as clips for retaining shear bar 99. For manufacturing expediency, the lower end of the insert is formed as a separate cap-piece 254 that incorporates the undercut portions 28' the shoulder 29' is defined by an end flange 256 on the main body 255 of the form. This flange 256 couples with a matching peripherally lipped seat 258 on cap-piece 254. It is to be noted here that cap-piece 254 has sufficient depth to accommodate debris which may happen to fall into the cavity of the insert, without the debris interfering with the correct location and movement of anchor head 45.

The edgelift system is used in the following manner. Anchor 65, including shaft 40 with adjacent lock rods 50, 51, is inserted into the complementary profile of the main portion 26 of insert 24. To allow insertion, shaft 40 must be rotated to a position (FIG. 1) in which anchor lugs 48*a*, 48*b* are in exact alignment or register with and disposed at the end of lock rods 50, 51. To push the anchor fully home into the cavity requires longitudinal opposition to a conical compression spring 80 fixed to the underside of swash plate 32 and extending loosely down about the upper or inner end of the shaft/lock rod combination. The spring recedes back into an annular recess 82 (FIG. 9) in the underside of the swash plate.

The orientation of the lever arm 42 serves as a guide to the orientation of the clutch with respect to the anchor. Correct orientation facilitates release of the clutch after the building element has been secured in place. For edgelift, the handle is oriented outwards the top surface of the element on the casting bed, and for facelift the handle is oriented towards what is to be the top edge of the element in its erected position in the structure.

When anchor 65 is fully home, lever arm 42 may be gripped and rotated from its projecting to its nested position to bring anchor lugs 48*a*, 48*b* out from behind lock rods 50, 51 into the undercuts 28 of cavity 22. By virtue of the engagement between follower pins 54 and cam track 55, any rotation of lift bar 60 causes lock rods 50, 51 to slide into a position in which they block return of anchor lugs 48*a*, 48*b* out of the undercut. This blocking engagement is indicated at 100 in FIG. 4. The crane tackle is attached to the lift bar 60 by engaging the appropriate shackle or sling about bridging portion 66. It will be seen from FIGS. 1 and 4 that, once lift bar 60 is rotated and the crane equipment is in tension as the panel is raised, the anchor lugs are blocked from disengagement from the undercuts. Indeed, it will not be possible for the anchor 65 to disengage from the cavity unless the lift bar is relaxed back to, or close to, the rest position shown in FIG. 1, ie that is against swash plate 32. Only then can the anchor lugs be released, either manually or by a remote release cable.

It will be understood that anchor 65 cannot be released until the load is removed from the sling, and the lift bar is depressed to within its range of rotation for the insertion setting. It is only practical to remove the load from the sling after the panel has been secured in position. With the load removed from the sling, and the lock rods raised by the return spring 84, the handle is rotated, either manually, or remotely with for example a cable, to its position in line with the lock rods. The cone spring ejects the anchor 65 from insert 24, and the crane is free to proceed to the next panel.

It will be further understood that the illustrated system entails only two manual operations during attachment ie. insertion of the anchor and rotation of lever arm 42, and one manual operation on detachment, ie. lever arm rotation. Locking, unlocking and removal are effected automatically, and the crane sling remains attached throughout all lifting operations.

The lift bar 60 is preferably dimensioned so that, when it is depressed against the swash plate or close to it, the anchor can be on the centreline of the panel edge without the lift bar fouling the surface of the casting bed. For example, the freshly cast panel may be 120 mm thick, and the lift bar can comfortably lie within 60 mm of axis 41.

The rotational mounting of lift bar 60 with respect to swash plate 32 allows the lift bar to be rotationally alignable with the direction of load, ie. with the lifting sling. When a load is applied lateral to the plane of the lift bar, the load originating from either the angle of the sling or an applied shear load, the pivoting mounting of the lift bar allows the lifting point to be in close proximity to the concrete face. This in turn prevents a load magnification by avoiding a leverage action.

It will be appreciated that, when the clutch/anchor 30 is fully engaged, there is substantially no void or cavity in the panel within a region outwardly of undercut shoulders 29 sufficient to allow collapse or flow of concrete when the panel is being lifted. This is because the lock rods 50, 51 wholly occupy the void traversed by anchor lug(s) 48*a*, 48*b* during insertion. It is found that, in this way and in conjunction with the relatively large load supporting surface area of the undercut shoulders and lugs, it is not necessary to provide reinforcing and load spreading metal components in cavity 22, such as the steel nut of Australian patent 488954 or the steel block of Australian patent application 89982/91, at the load bearing surface at the tops of anchor lugs 48*a*, 48*b*. The applicant has thus achieved an anchor system wholly free of permanently cast-in metal components, as it is believed that the filling of the void and the flat 60° engagement of the anchor lugs 48*a*, 48*b* under the respective shoulders 29 provides sufficient strength and load spread to maintain the assembly under full lifting load.

It was remarked above that there is substantially no void or cavity in the panel within a region outwardly of undercut shoulders 29 sufficient to allow collapse or flow of concrete when the panel is being lifted. Of course, this not to say that there is no void or cavity in the mentioned region. For example, the periphery of form 25 may comprise a ribbed, corrugated or open lattice structure which includes multiple fine cavities or channels, but these cavities or channels are sufficiently small—even if exposed to concrete—for there to be no collapse or flow of concrete into the cavities or channels during normal operation.

It will be further appreciated that cone spring 80 serves the useful role that, if the clutch is not engaged with the insert by rotation of shaft 40, the spring will wholly or partly eject the anchor out of the cavity, thereby rendering the lack of engagement visually obvious. A further visual warning can be obtained by the relative position of the handle 42*a* of lever arm 42 within the rotation path of lift bar 60 and the crane sling, indicating that anchor 65 has not yet gripped insert 24 since the lever handle has not yet been rotated to the nested, engaging position. It would be a simple matter to colour the outer upstanding handle 42*a* of the lever to make its position obvious to a person viewing from laterally of the trunnion axis.

The pressure of the cone spring holds the shaft anchor lugs 48*a*, 48*b* against the undercut shoulders 29.

Lock rods 50, 51 are biased outwardly, and the cam followers 54 thereby maintained in engagement with the cam tracks 55, by a helical spring 84 disposed in the earlier mentioned annular gap 39 between ring 58 and shoulder 47 on anchor head 45. Ring 58 is affixed to rods 50, 51 and is moveable with the rods in the gap, thereby compressing the spring 84 once the rods commence their sliding movement to the blocking position. Ring 58 also assists in maintaining lock rods 50, 51 in place. It should be noted that, to prevent their forming voids into which concrete flow or collapse can occur, annular gap 39 is at a minimum distance from the end of anchor 65, eg about ⅓ of its length.

Figure 4:
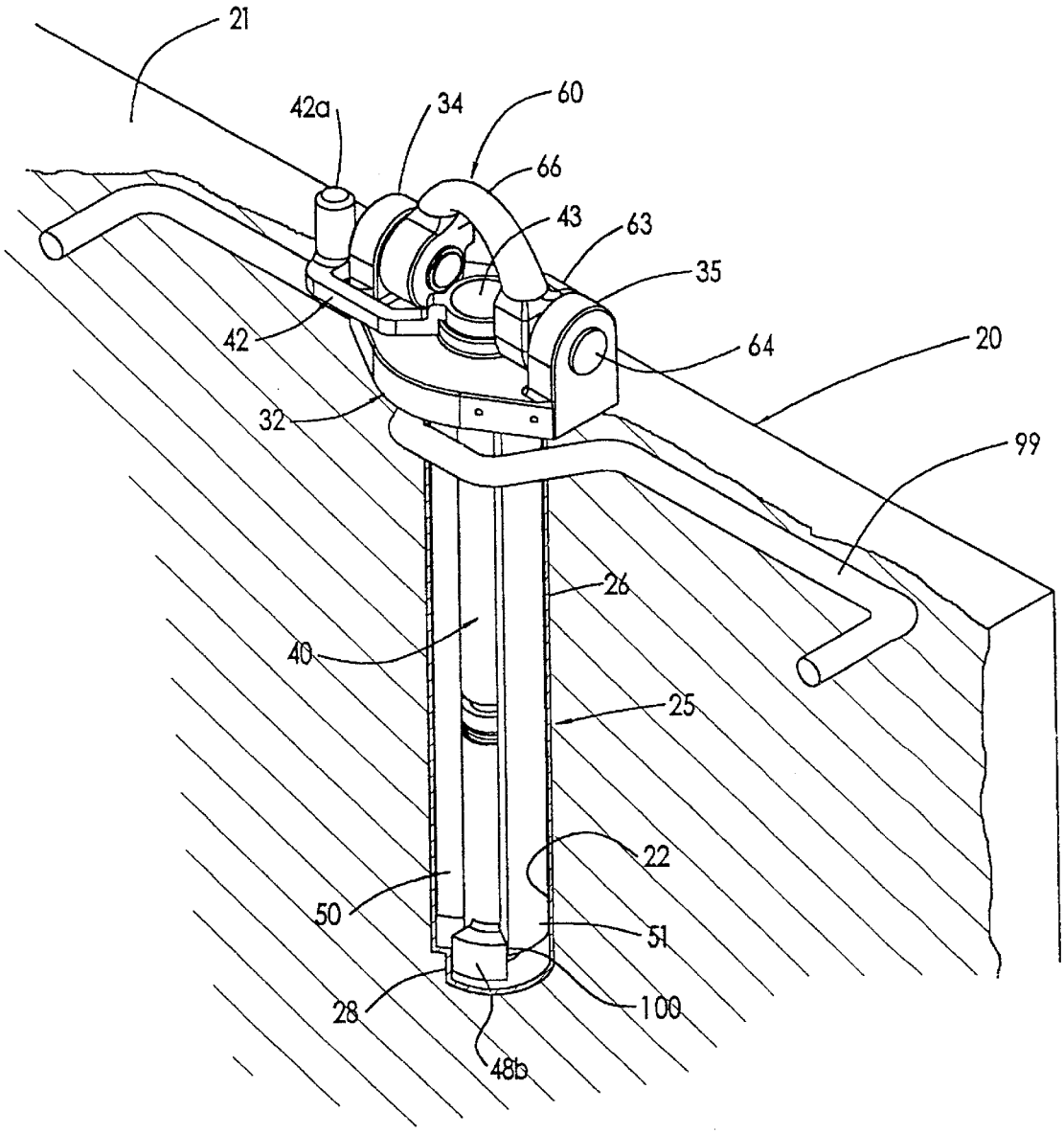
FIG. 4 is a view similar to FIG. 1 but with the lift advice or clutch/anchor shown in situ in the panel edge after it has been lifted to a vertical orientation by a crane.
Figure 5:
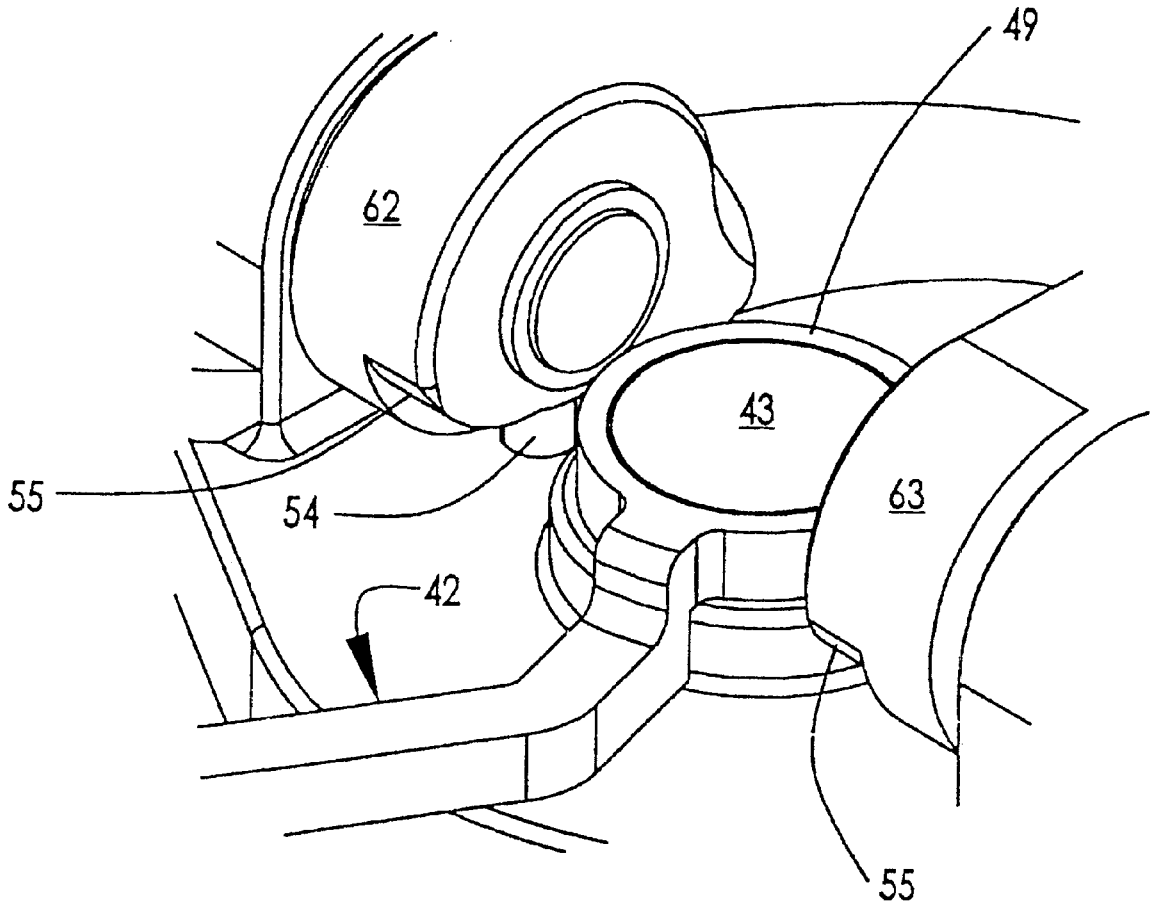
FIGS. 5 and 6 are respective enlargements of portions of FIG. 1.
Figure 6:
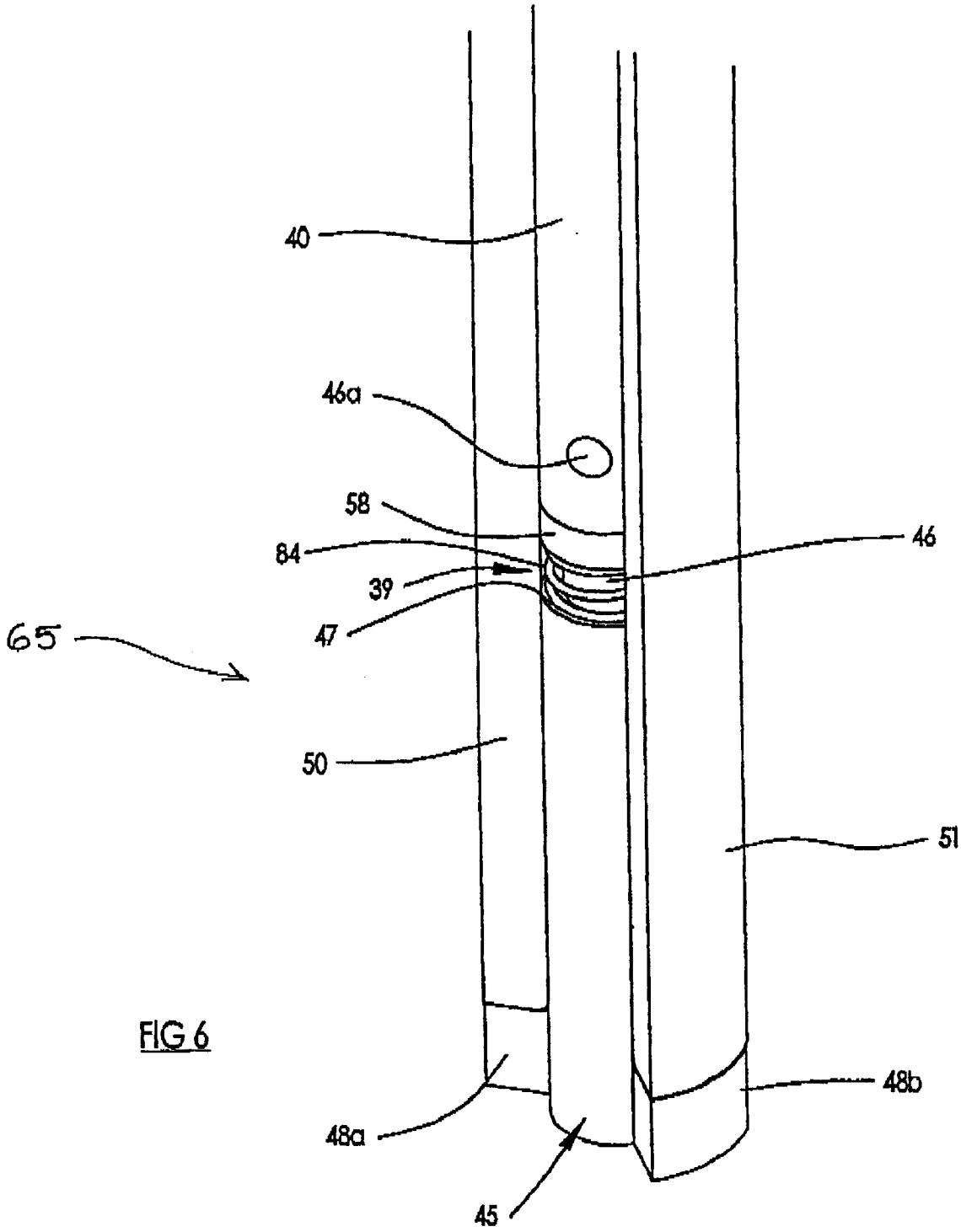
Figure 7:
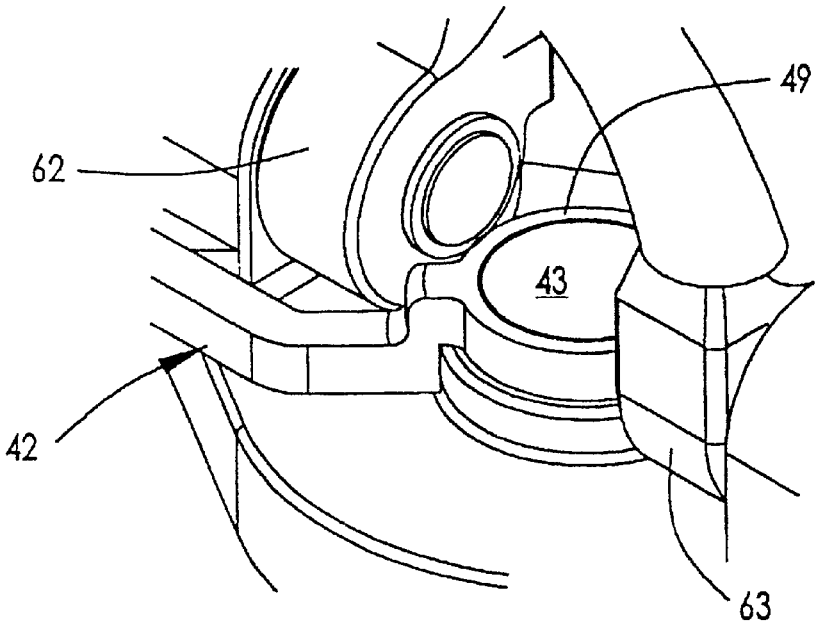
FIGS. 7 and 8 are corresponding enlargements of portions of FIG. 4.
Figure 8:
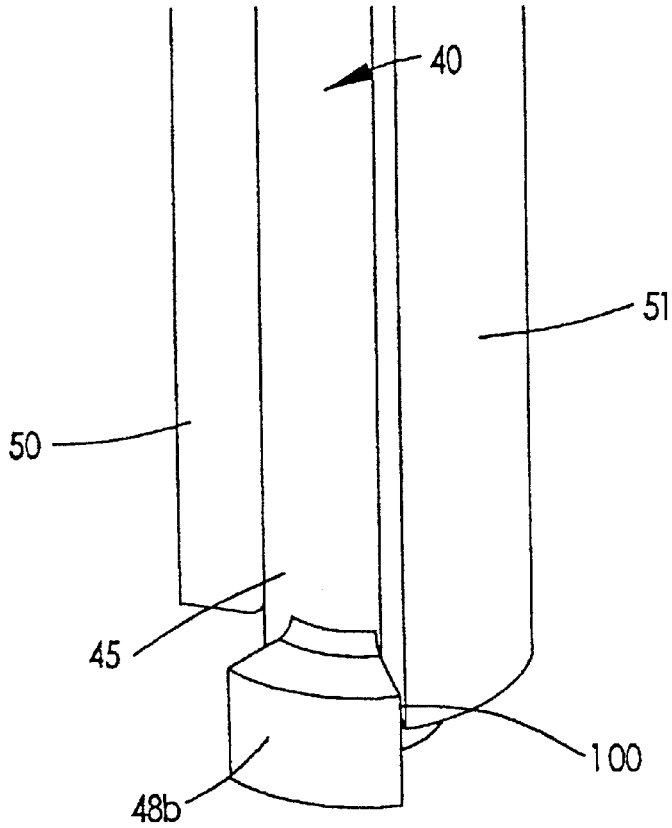

The asymmetric arrangement of bridging portion 66 of lift body 60, particularly evident in FIG. 4, by which the portion bridges one end of block 62 to the other end of block 63, is provided to allow a D-shackle to be placed around the bridging portion between it and the adjacent swash plate 32 when the lift body is in its relaxed position, and yet still have the line of lift substantially along axis 41.

The illustrated embodiment is best suited to an edgelift system, where there is no limitation on the depth of cavity 22, but where the thickness of panel limits a minimal lateral movement of lugs 48*a*, 48*b*. In this case, the open end of form 25 is attached with a plate to further formwork to support the form horizontally. In a counterpart facelift system, the subtended angle of lugs 48*a*, 48*b* and block rods 50, 51 is 90°; with a lesser available depth, it is important to increase the load bearing surface area of shoulder 29. Of course, this will mean that the cavity will be cylindrical at the undercuts. This in turn is not a problem where there is no lateral limit on the extent of the cavity. With the edge lift system, there is such a lateral limit and hence the 60° dovetail is employed, but without load bearing disadvantage in view of the greater available depth of the cavity.

In a facelift system, the present arrangement can achieve greater effective depth in view of the lack of any crossbar component as in the aforementioned German patent application 195 23 476. The greater thickness of concrete above the lugs gives a significant increase in load-carrying capacity. A further advantage over the prior disclosure is that the present system has a solid load-bearing shaft component (shaft 40) rather than a tubular load-bearing component.

Figure 14:
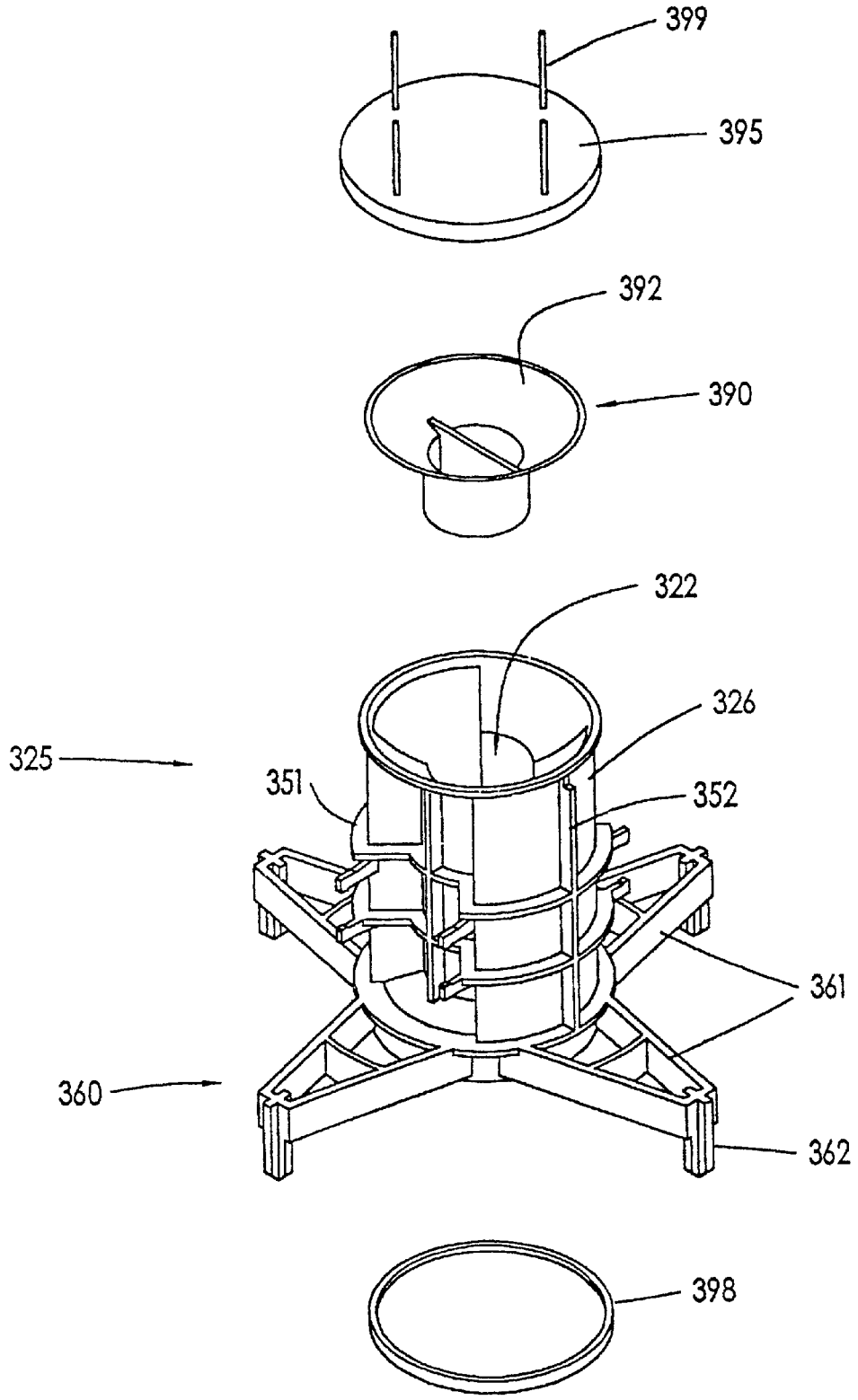
FIGS. 14 and 15 illustrate a form suitable for facelift systems, respectively shown in exploded and assembled views.
Figure 15:
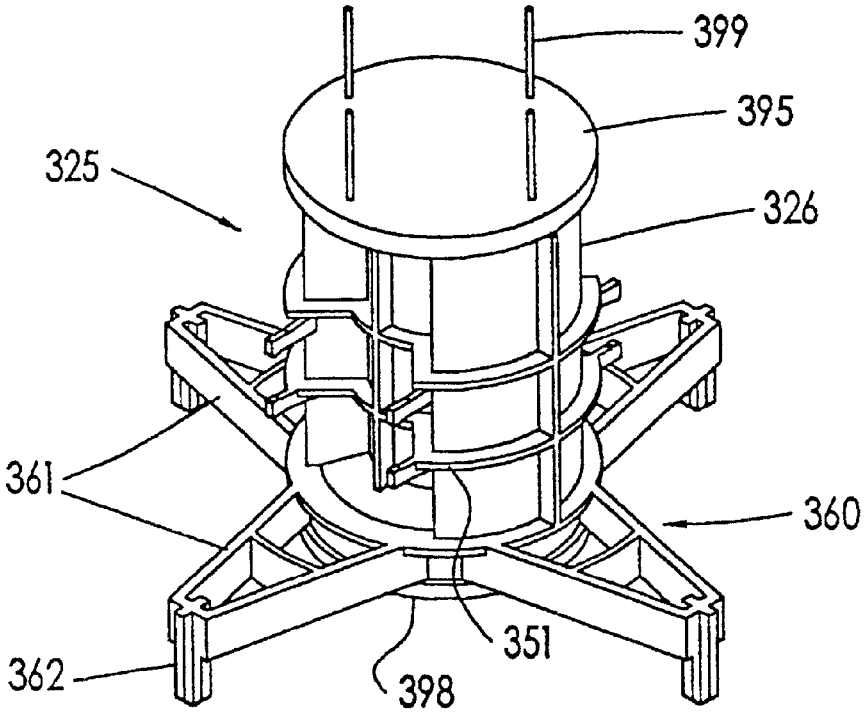

FIGS. 14 (exploded view) and 15 (assembled view) illustrate a suitable integral moulded plastics form 325 for an embodiment of the invention applicable to a facelift system. The main portion 326 is similar to portion 26 of the edgelift form 25, except that it is relatively much shorter and that it has integral annular and longitudinal strengthening ribs 351, 352. The inner end of the form has four outwardly tapering legs 361 with outer feet 362 which together comprise a base 360 to support the form in a vertical position in a casting bed. Form 325 is provided with a tray, and formwork top cap 395: in this case tray is shaped to define a part-spherical bowl 392. This matches a complementary surface in the upper face of form 325, which in turn matches a complementary projection on the underside of the associated swash plate. The otherwise open bottom end of the form is closed by a bottom cap 398.

In casting the panel with multiple forms 325 in place, the concrete is trowelled off just above the flat outer face of top cap 395. When it is desired to lift the panel, the thin wafer of concrete over the form (its location signalled by protruding pins 399) is broken away and the top cap 395 removed. Debris is collected in the bowl 392 of tray 390. It is also to be noted that in a fashion similar to the earlier described edgelift embodiment of FIG. 13, the inner end of form 325 is arranged so that there is some room for debris on the inside of bottom cap 398 below the anchor head. Tray 390 with the debris collected in it is removed just before insertion of the clutch anchor.

Another difference between edgelift and facelift systems embodying the invention is in relation to the angular range for which lift body 60 activates lock rods 50, 51 into a blocking position. With the illustrated edgelift embodiment, this will be for a 5–90° range, whereas the 45–90° range is appropriate for facelift.

Figure 16:
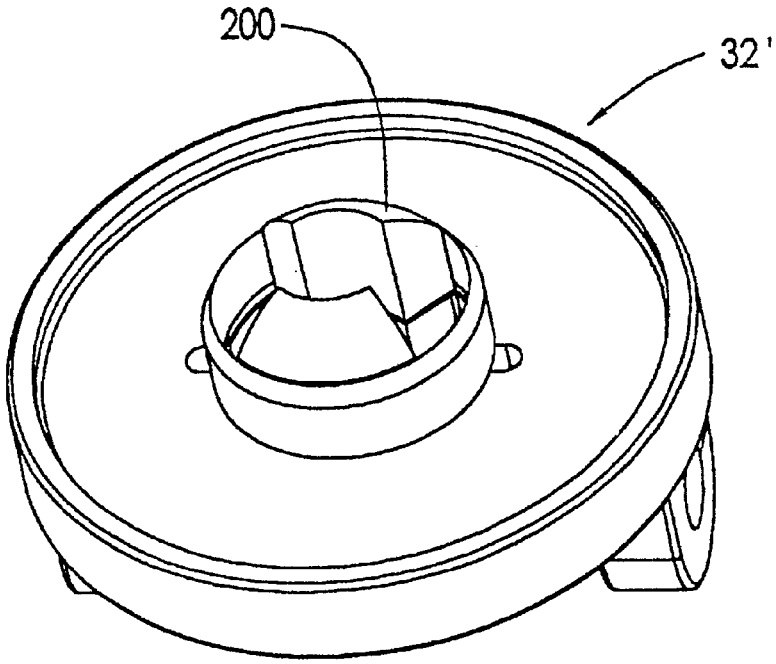
FIG. 16 is an underneath view of a modified swash plate especially suitable for a facelift system.

FIG. 16 depicts a modified swash plate 32' especially suitable for a facelift system. The under surface of the swash plate has been extended around the shaft and lock rods, to form a projection 200 ending in a partial sphere. FIG. 16 shows a bottom view of the face lift clutch-anchor swash plate, with the shaft, lock rods, and conical spring removed. The projection 200 is matched by a similar cavity (not shown) formed into the surface of the concrete at the top of the insert, and the extension occupies this cavity when the clutch-anchor is attached. The purpose of the extension is to assist in the transfer of shear loads to the concrete without the need for a shear bar, as is preferred in the case of edge lift. (eg. at 99 in FIG. 4) In face lift there is an extensive mass of concrete surrounding the insert, and this concrete is quite capable of resisting the shear loads, without reinforcement. In the case of edge lift however, the insert is placed in a relatively narrow edge without sufficient concrete above the insert to resist shear loads without additional reinforcement.

Figure 9:
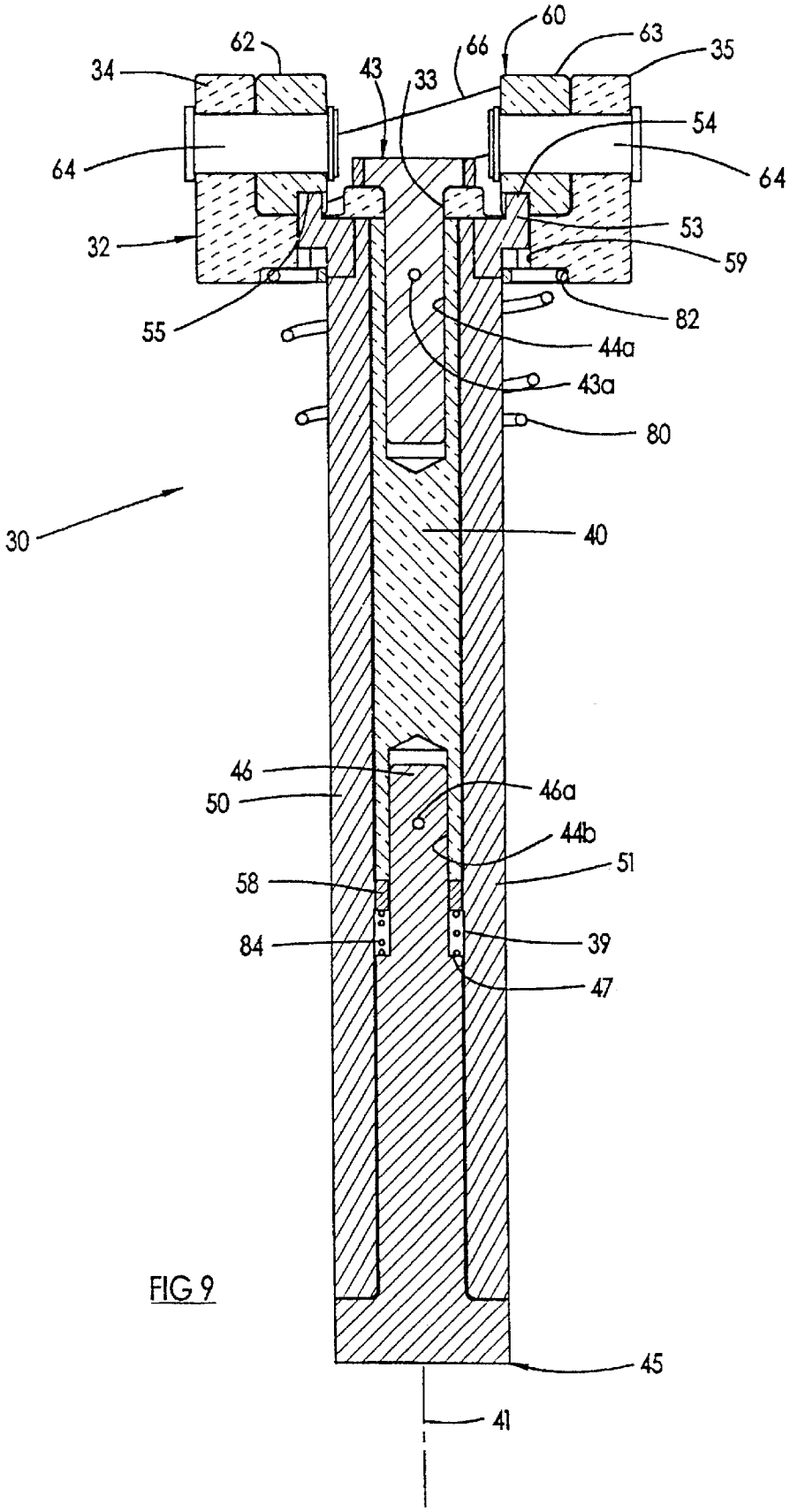
FIGS. 9 and 10 are respectively axial cross sections on the lines 9—9 and 10—10 in FIG. 1.
Figure 10:
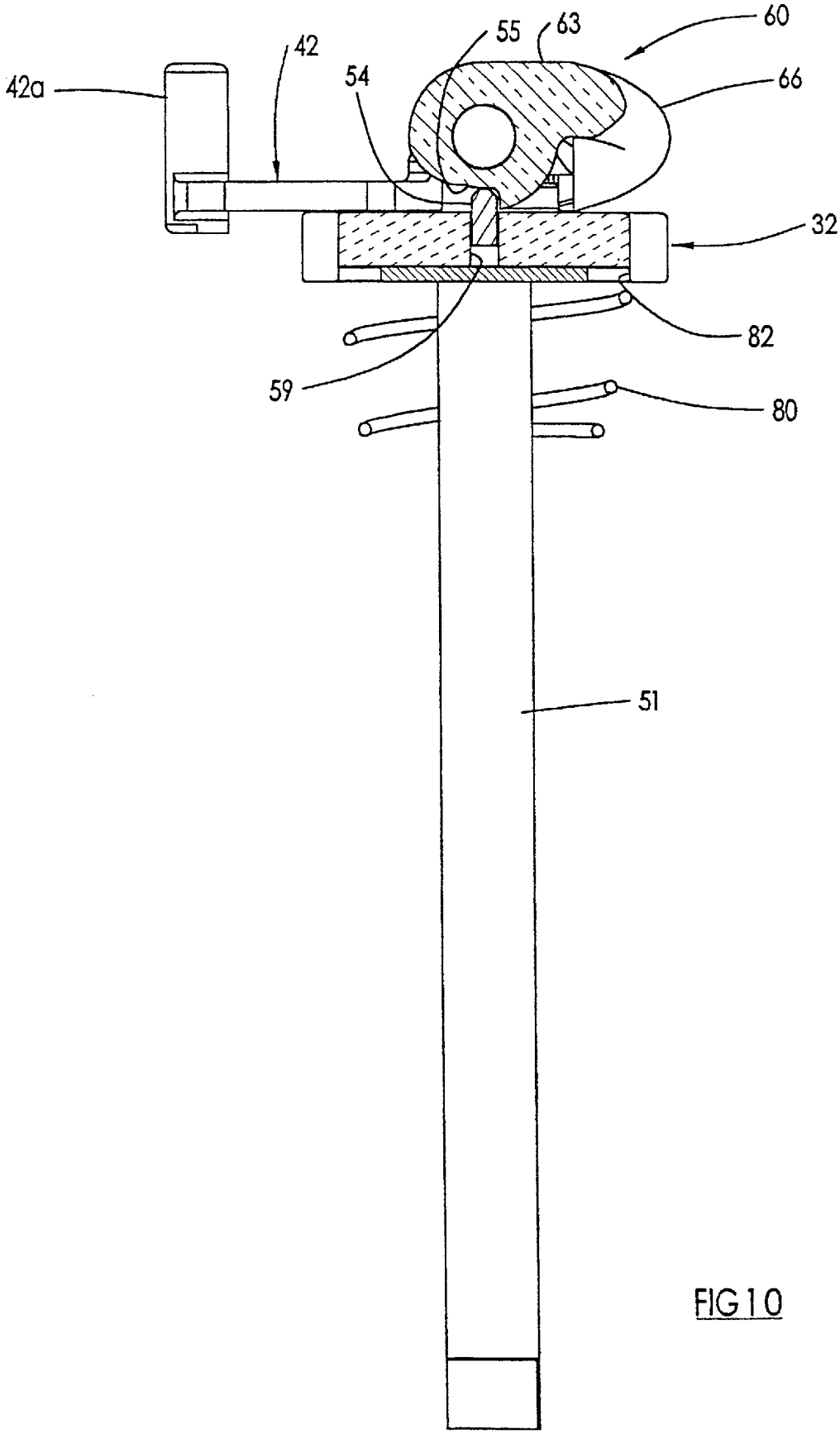
Figure 11:
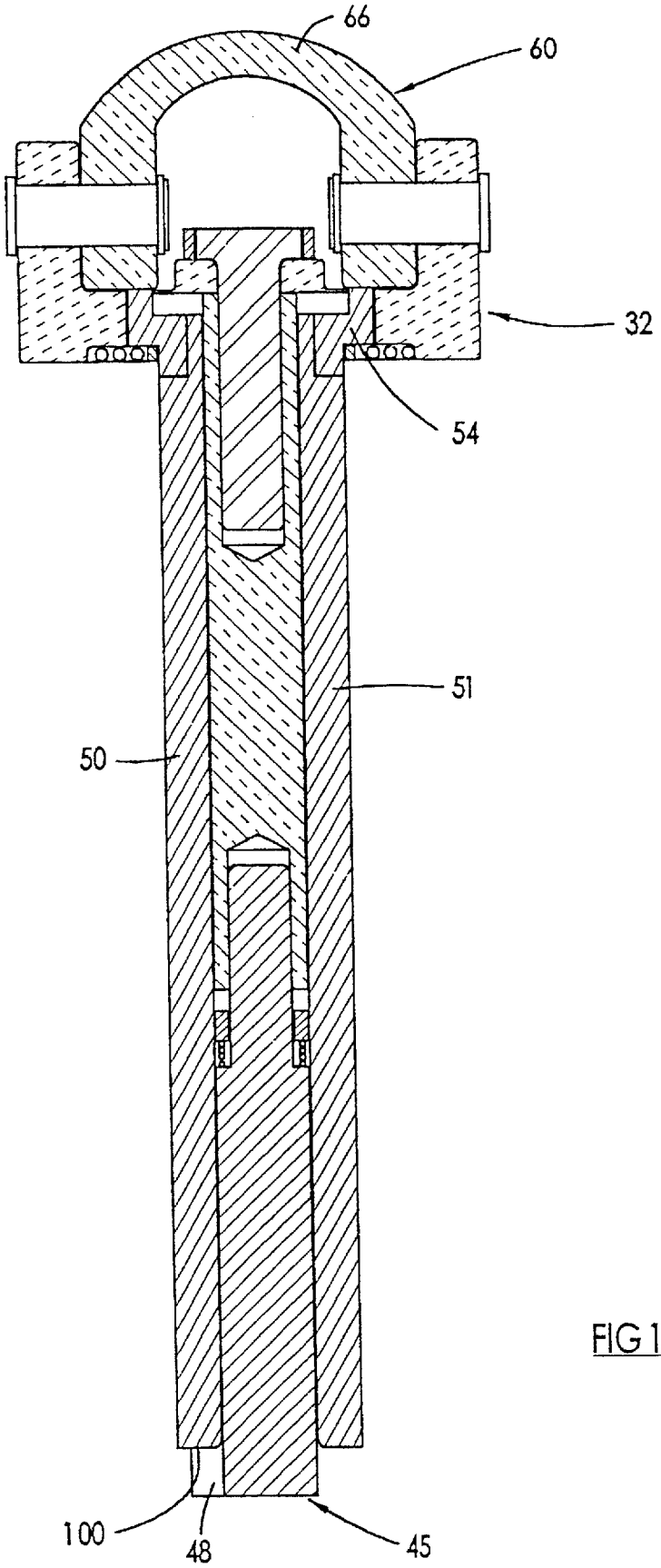
FIGS. 11 and 12 are respective matching cross sections corresponding to FIGS. 9 and 10, but for the condition of FIG. 4.
Figure 12:
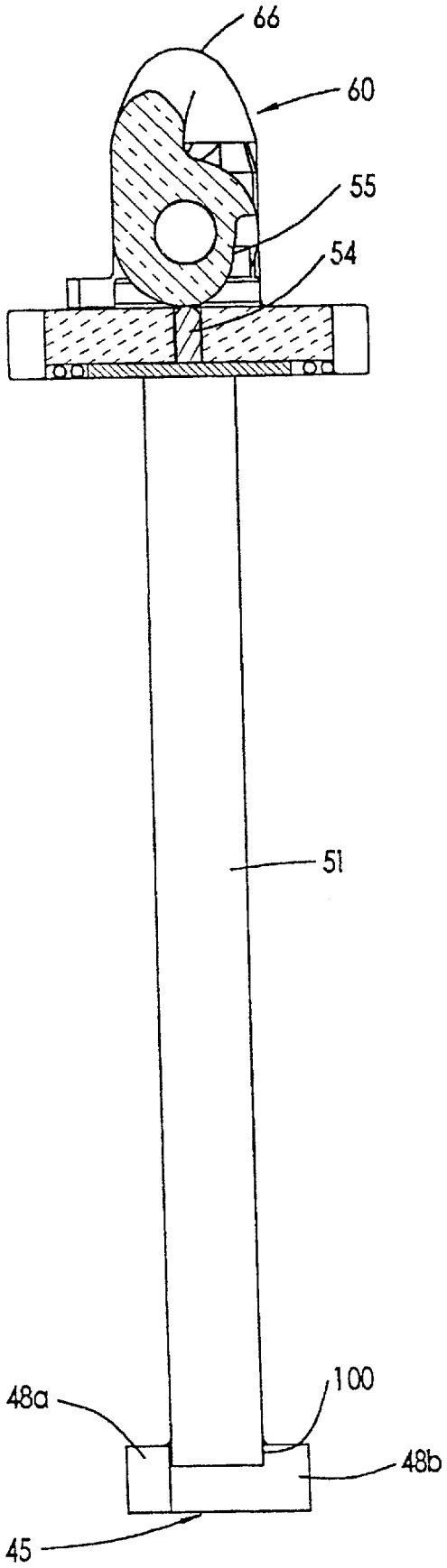
Figure 17:
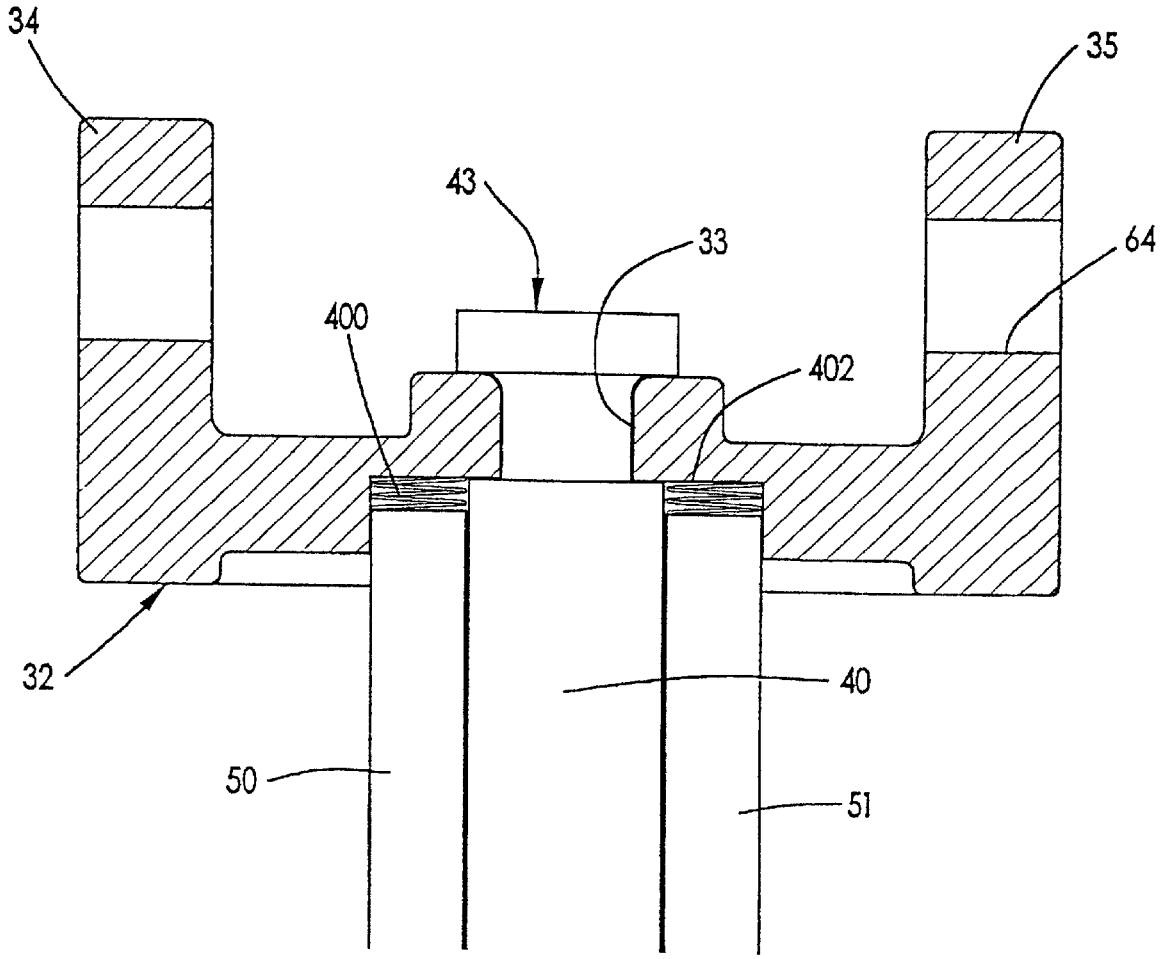
FIG. 17 is a fragmentary cross-section corresponding to part of FIG. 9, illustrating a modified arrangement.

FIG. 17 is a fragmentary cross-section corresponding to part of FIG. 9, illustrating a modification in which the lock rods 50, 51, automatically descend to block return of the anchor lugs 48*a*, 48*b*, in response to rotation of anchor shaft 40. This is achieved by spring loading the lock rods downwards, by one or more helical compression springs 400 in one or more cavities 402 between the upper ends of the lock rods and the underside of the swash plate. An alternative construction is for a cam arrangement by which the rods are directly depressed by the ring 49 of lever arm 42 as it rotates. A still further alternative is to have a spring loaded swash plate that engages an enlargement or protrusion on the lever arm or an attachment thereto, so that the anchor lugs are indirectly locked against disengagement by blocking the lever arm 42 against return rotation.

What is claimed is:

1. An object handling device including:

a support body;

an elongate anchor body, having a proximal end, a distal end, and a longitudinal dimension extending between said proximal and distal ends, which body is mounted at said proximal end thereof to said support body so as to project from the support body for insertion into an undercut cavity extending into an object from an edge or face of the object to be handled and so as to be rotatable about an axis generally parallel to said longitudinal dimension of said anchor body;

at least one anchor lug at or adjacent to said distal end of the anchor body movable by rotation of the anchor body between a first position in which the anchor body is able to be inserted into or withdrawn from the cavity, and a second position in which said at least one anchor lug engages a respective undercut shoulder portion in said cavity;

means on said anchor body engagable for rotating said anchor body to move said at least one anchor lug between said first and second positions;

lift means on said support body engagable by a crane to lift the object; and lock means responsive to said lift means to block movement of said at least one anchor lug from said second position.

2. An object handling device according to claim 1, wherein the lift means co-operatively engages the lock means without rotation of the lock means about any notional axis generally parallel with said axis.

3. An object handling device according to claim 1 wherein said lift means is a solid component rotatably carried by the support body for movement between a first position in which the lock means does not block said at least one anchor lug and a range of rotational positions in which it does.

4. An object handling device according to claim 3 further including a cam and cam follower arrangement by which the lift means co-operatively engages the lock means by rotation of the lift means about an axis generally transverse to said longitudinal dimension of the anchor body, whereby said lock means is responsive to said lift means to block movement of said at least one anchor lug from said second position.

5. An object handling device according to claim 1 wherein said lock means includes means slidable generally longitudinally of said anchor body to a blocking position in which movement of said at least one anchor lug from said second position is blocked.

6. An object handling device according to claim 5 wherein said lock means further includes means responsive to said lift means to activate the lock means to slide it to said blocking position.

7. An object handling device according to claim 5 wherein there are a plurality of said anchor lugs and said lock means includes a plurality of lock rods of cross section similar to and matching the cross section of the respective said anchor lugs in a plane normal to said axis, whereby said anchor lugs are aligned with the lock rods during insertion or withdrawal of the device, and move out of alignment in said second position, thereby defining respective spaces vacated by said anchor lugs, whereupon the lock rods slide into the vacated spaces and thereby block movement of said anchor lugs back to the first position.

8. An object handling device according to claim 7 wherein said elongate anchor body is generally cylindrical and said anchor lugs and lock rods exhibit dovetail or part annular profiles to opposite sides of the anchor body as viewed in cross section.

9. An object handling device according to claim 1 wherein said device is shaped and configured for said insertion of said anchor body so that, when said at least one anchor lug is in said second position, there is substantially no cavity or void in said object within a region outwards of said undercut shoulder portion sufficient to allow collapse or flow of material of the object when said object is being lifted.

10. An object handling device according to claim 1 wherein said object is a concrete panel and said device is shaped and configured for said insertion of said anchor body so that, when said at least one anchor lug is in said second position, there is substantially no cavity or void in said object within a region outwards of said undercut shoulder portion sufficient to allow failure of the concrete of the panel, when said object is being lifted, through generation of a shear cone before failure occurs through collapse or flow of the concrete into any void or cavity.

11. An object handling device according to claim 1 wherein said means engagable for moving said anchor lugs includes a manipulable handle carried by the support body on the side opposite that from which the anchor body extends.

12. An object handling device according to claim 1 further including means to bias the lock means to a position in which it does not block movement of said anchor lugs.

13. An object handling device according to claim 1 further including means to bias said support body clear of said edge or face of the object surface about the cavity unless it is pushed into the cavity and said anchor lugs engaged.

14. An object handling device according to claim 1 wherein said lock means is responsive to rotation of said anchor body.

15. An object handling device according to claim 1 wherein said lock means includes means on said support body to block said means for rotating said anchor body against return rotation.

16. An object handling device according to claim 1, wherein said lift means is rotatably mounted with respect to the support body and is thereby rotationally alignable with the direction of load.

17. An object handling device according to claim 16, wherein the lift means cooperatively engages the lock means without rotation of the lock means about any rotational axis generally parallel with said axis.

18. An object handling device according to claim 16 wherein said lift means is a solid component rotatably carried by the support body for movement between a first position in which the lock means does not block said at least one anchor lug and a range or positions in which it does.

19. An object handling device according to claim 18 wherein said lock means is responsive to said lift means by means of a cam and cam follower arrangement by which the lift means co-operatively engages said lock means by rotation of the lift means about an axis generally transverse to said longitudinal dimension of the anchor body.

20. An object handling device according to claim 16 wherein said means engagable for moving said anchor lugs includes a manipulable handle carried by the support body on the side opposite that from which said anchor body extends.

21. An object handling device including:

a support body;

elongate anchor body means having a proximal end, a distal end and a longitudinal dimension extending between said proximal and distal ends, and having an axis generally parallel to said longitudinal dimension, where said anchor body means is mounted at said proximal end thereof to said support body so as to project from the support body for insertion into an undercut cavity extending into an object from an edge or face of the object to be handled;

at least one anchor lug at or adjacent to said distal end of the anchor body means moveable with the anchor body means between a first position in which the anchor body means is able to be inserted into or withdrawn from the cavity, and a second position in which said at least one anchor lug engages respective undercut shoulder portion in said cavity;

means on said anchor body means engagable for moving said at least one anchor lug between said first and second positions;

lock means slidable generally longitudinally of said anchor body means to a blocking position in which movement of said at least one anchor lug from said second position is blocked;

lift means carried by said support body engagable by a crane to lift said object; and means responsive to said lift means to activate the lock means to slide it to said blocking position.

22. An object handling device according to claim 21 wherein there are a plurality of said anchor lugs and said lock means includes a plurality of lock rods of cross section similar to and matching the cross section of the respective said anchor lugs in a plane normal to said axis, whereby said anchor lugs are aligned with the lock rods during insertion or withdrawal of the device, and move out of alignment in said second position, thereby defining respective spaces vacated by said anchor lugs, whereupon the lock rods slide into the vacated space and thereby block movement of said anchor lugs back into the first position.

23. An object handling device according to claim 22 wherein said elongate anchor body means is generally cylindrical and said anchor lugs and lock rods exhibit dovetail or part annular profiles to opposite sides of said anchor body means as viewed in cross section.

24. An object handling device according to claim 21 wherein said device is shaped and configured for said insertion of said anchor body means so that, when said at least one anchor lug is in said second position, there is substantially no cavity or void in said object within a region outwards of said undercut shoulder portion sufficient to allow collapse or flow of material of the object when said object is being lifted.

25. An object handling device according to claim 24 wherein said object is a concrete panel and said device is shaped and configured for said insertion of said anchor body means so that, when said at least one anchor lug is in said second position, there is substantially no cavity or void in said object within a region outwards of said undercut shoulder portion sufficient to allow failure of the concrete of the panel, when said object is being lifted, through generation of a shear cone before failure occurs through collapse or flow of the concrete into any void or cavity.

26. An object handling device according to claim 21 wherein said means engagable for moving said anchor lugs includes a manipulable handle carried by the support body on the side opposite that from which the anchor body means extends.

27. An object handling device according to claim 21 wherein the lift means cooperatively engages the lock means without rotation of the lock means about any axis generally parallel with the said axis.

28. An object handling device according to claim 21 wherein said lift means is a solid component rotatably carried by the support body for movement between a first position in which the lock means does not block the said at least one anchor lug and a range of rotational positions in which it does.

29. An object handling device according to claim 28 wherein said lock means is responsive to said lift by means of a cam and cam follower arrangement by which the lift means co-operatively engages the lock means by rotation of the lift means about an axis generally transverse to said longitudinal dimension of said anchor body means.

30. An object handling device according to claim 21 further including means to bias the lock means to a position in which it does not block movement of said anchor lugs.

31. An object handling device according to claim 21 further including means to bias to support body of the lift means clear of said object surface about the cavity unless it is pushed into the cavity and said anchor lugs engaged.

32. An object handling device including:

a support body;

elongate anchor body means having a proximal end, a distal end and a longitudinal dimension extending between said proximal and distal ends, and having an axis generally parallel to said longitudinal dimension, where said anchor body means is mounted at said proximal end thereof to said support body so as to project from the support body for insertion into an undercut cavity extending into an object from an edge or face of the object to be handled;

at least one anchor lug at or adjacent to said distal end of the anchor body means moveable with the anchor body means between a first position in which said anchor body means is able to be inserted into or withdrawn from the cavity, and a second position in which said at least one anchor lug engages a respective undercut shoulder portion in said cavity;

means on said anchor body means engagable for moving said at least one anchor lug between said first and second positions;

lift means on said support body engagable by a crane to lift the object; and lock means responsive to said lift means to block movement of said at least one anchor lug from said second position;

wherein said device is shaped and configured for said insertion so that, when said at least one anchor lug is in said second position, there is substantially no cavity or void in said object within a region outwards of said undercut shoulder portion sufficient to allow collapse or flow of material of the object when said object is being lifted.

33. An object handling device according to claim 32 wherein said object is a concrete panel and said device is shaped and configured for said insertion of said anchor body means so that, when said at least one anchor lug is in said second position, there is substantially no cavity or void in said object within a region outwards of said undercut shoulder portion sufficient to allow failure of the concrete of the panel, when said object is being lifted, through generation of a shear cone before failure occurs through collapse or flow of the concrete into any void or cavity.

34. An object handling device according to claim 32 wherein said lock means includes means slidable generally longitudinally of said anchor body means to a blocking position in which movement of said at least one anchor lug from said second position is blocked.

35. An object handling device according to claim 34 further including means responsive to said lift means to activate the lock means to slide it to said blocking position.

36. An object handling device according to claim 34, wherein the lift means cooperatively engages the lock means without rotation of the lock means about any axis generally parallel with said axis.

37. An object handling device according to claim 34 wherein said lift means is a solid component rotatably carried by the support body for movement between a first position in which the lock means does not block said at least one anchor lug and a range of rotational positions in which it does.

38. An object handling device according to claim 37 wherein said lock means is responsive to said lift by means of a cam and cam follower arrangement by which the lift means co-operatively engages the lock means by rotation of the lift means about an axis generally transverse to the longitudinal dimension of said anchor body means.

39. An object handling device according to claim 34 wherein there are a plurality of said anchor lugs and said lock means includes a plurality of lock rods of cross section similar to and matching the cross section of the respective said anchor lugs in a plane normal to said axis, whereby said anchor lugs are aligned with the lock rods during insertion or withdrawal of the device, and move out of alignment in said second position, thereby defining respective spaces vacated by said anchor lugs whereupon the lock rods slide into the vacated spaces and thereby block movement of said anchor lugs back to the first position.

40. An object handling device according to claim 39 wherein said elongate anchor body means is generally cylindrical and said anchor lugs and lock rods exhibit dovetail or part annular profiles to opposite sides of said anchor body means as viewed in cross section.

41. An object handling device according to claim 32 wherein said means engagable for moving said anchor lugs includes a manipulable handle carried by the support body on the side opposite that from which said anchor body means extends.

42. An object handling device according to claim 32 further including means to bias the lock means to a position in which it does not block movement of said anchor lugs.

43. An object handling device according to claim 32 further including means to bias the support body of the lift means clear of said object surface about the cavity unless it is pushed into the cavity and said anchor lugs engaged.

44. An object handling device including:

a support body;

an elongate anchor body, having a proximal end, a distal end, and a longitudinal dimension extending between said proximal and distal ends, which body is mounted at said proximal end thereof to said support body so as to project from the support body for insertion into an undercut cavity extending into an object from an edge or face of the object to be handled and so as to be rotatable about an axis generally parallel to said longitudinal dimension of said anchor body;

at least one anchor lug at or adjacent to said distal end of the anchor body movable by rotation of the anchor body between a first position in which the anchor body is able to be inserted into or withdrawn from the cavity, and a second position in which said at least one anchor lug engages a respective undercut shoulder portion in said cavity;

means on said anchor body engagable for rotating said anchor body to move said at least one anchor lug between said first and second positions;

lift means on said support body engagable by a crane to lift the object; and lock means to block movement of said at least one anchor lug from said second position;

wherein said lock means includes means slidable generally longitudinally of said anchor body to a blocking position in which movement of said at least one anchor lug from said second position is blocked; and wherein there are a plurality of said anchor lugs and said lock means includes a plurality of lock rods of cross section similar to and matching to cross section of the said anchor lugs in a plane normal to said axis, whereby said anchor lugs are aligned with the lock rods during insertion or withdrawal of the device, and move out of alignment in said second position, thereby defining respective spaces vacated by said anchor lugs, whereupon the lock rods slide into the vacated spaces and thereby block movement of said anchor lugs back to the first position.

45. An object handling device according to claim 44 wherein said elongate anchor body is generally cylindrical and said anchor lugs and lock rods exhibit dovetail or part annular profiles to opposite sides of the anchor body as viewed in cross section.

46. An object handling device according to claim 44 wherein said device is shaped and configured for said insertion of said anchor body so that, when said at least one anchor lug is in said second position, there is substantially no cavity or void in said object within a region outwards of said undercut shoulder portion sufficient to allow collapse or flow of material of the object when said object is being lifted.

47. An object handling device including:

a support body;

an elongate anchor body, having a proximal end, a distal end and a longitudinal dimension extending between said proximal and distal ends, which body is mounted at said proximal end thereof to said support body so as to project from the support body for insertion into an undercut cavity extending into an object from an edge or face of the object to be handled and so as to be rotatable about an axis generally parallel to said longitudinal dimension of said anchor body;

at least one anchor lug at or adjacent to said distal end of the anchor body movable by rotation of the anchor body between a first position in which the anchor body is able to be inserted into or withdrawn from the cavity, and a second position in which said at least one anchor lug engages a respective undercut shoulder portion in said cavity;

means on said anchor body engagable for rotating said anchor body to move said at least one anchor lug between said first and second positions;

lift means on said support body engagable by a crane to lift the object; and lock means to block movement of said at least one anchor lug from said second position;

wherein said device is shaped and configured for said insertion of said anchor body so that, when said at least one anchor lug is in said second position, there is substantially no cavity of void in said object within a region outwards of said undercut shoulder portion sufficient to allow collapse or flow of material of the object when said object is being lifted.

48. An object handling device according to claim 47 wherein said object is a concrete panel and said device is shaped and configured for said insertion of said anchor body so that, when said at least one anchor lug is in said second position, there is substantially no cavity or void in said object within a region outwards of said undercut shoulder portion sufficient to allow failure of the concrete of the panel through generation of a shear cone before failure occurs through collapse or flow of the concrete into any void or cavity.

49. An object handling device including:

a support body;

an elongate anchor body, having a proximal end, a distal end and a longitudinal dimension extending between said proximal and distal ends, which body is mounted at said proximal end thereof to said support body so as to project from the support body for insertion into an undercut cavity extending into an object from an edge or face of the object to be handled and so as to be rotatable about an axis generally parallel to said longitudinal dimension of said anchor body;

at least one anchor lug at or adjacent to said distal end of the anchor body movable by rotation of the anchor body between a first position in which the anchor body is able to be inserted into or withdrawn from the cavity, and a second position in which said at least one anchor lug engages a respective undercut shoulder portion in said cavity;

means on said anchor body engagable for rotating said anchor body to move said at least one anchor lug between said first and second positions;

lift means on said support body engagable by a crane to lift the object;

lock means to block movement of said at least one anchor lug from said second position; and means to bias the lock means to a position in which it does not block movement of said anchor lugs.

50. An object handling device including:

a support body;

an elongate anchor body, having a proximal end, a distal end and a longitudinal dimension extending between said proximal and distal ends, which body is mounted at said proximal end thereof to said support body so as to project from the support body for insertion into an undercut cavity extending into an object from an edge or face of the object to be handled and so as to be rotatable about an axis generally parallel to said longitudinal dimension of said anchor body;

at least one anchor lug at or adjacent to said distal end of the anchor body movable by rotation of the anchor body between a first position in which the anchor body is able to be inserted into or withdrawn from the cavity, and a second position in which said at least one anchor lug engages a respective undercut shoulder portion in said cavity;

means on said anchor body engagable for rotating said anchor body to move said at least one anchor lug between said first and second positions;

lift means on said support body engagable by a crane to lift the object;

lock means to block movement of said at least one anchor lug from said second position; and means to bias said support body clear of said edge or face of the object surface about the cavity unless it is pushed into the cavity and said anchor lugs engaged.

51. An object handling device including:

a support body;

an elongate anchor body, having a proximal end, a distal end and a longitudinal dimension extending between said proximal and distal ends, which body is mounted at said proximal end thereof to said support body so as to project from the support body for insertion into an undercut cavity extending into an object from an edge or face of the object to be handled and so as to be rotatable about an axis generally parallel to said longitudinal dimension of said anchor body;

at least one anchor lug at or adjacent to said distal end of the anchor body movable by rotation of the anchor body between a first position in which the anchor body is able to be inserted into or withdrawn from the cavity, and a second position in which said at least one anchor lug engages a respective undercut shoulder portion in said cavity;

means on said anchor body engagable for rotating said anchor body to move said at least one anchor lug between said first and second positions;

lift means on said support body engagable by a crane to lift the object; and lock means responsive to rotation of said anchor body to block movement of said at least one anchor lug from said second position.

52. An object handling device including:

a support body;

an elongate anchor body, having a proximal end, a distal end and a longitudinal dimension extending between said proximal and distal ends, which body is mounted at said proximal end thereof to said support body so as to project from the support body for insertion into an undercut cavity extending into an object from an edge or face of the object to be handled and so as to be rotatable about an axis generally parallel to said longitudinal dimension of said anchor body;

at least one anchor lug at or adjacent to said distal end of the anchor body movable by rotation of the anchor body between a first position in which the anchor body is able to be inserted into or withdrawn from the cavity, and a second position in which said at least one anchor lug engages respective undercut shoulder portion in said cavity;

means on said anchor body engagable for rotating said anchor body to move said at least one anchor lug between said first and second positions;

lift means on said support body engagable by a crane to lift the object; and lock means to block movement of said at least one anchor lug from said second position, including means on said support body to block said means for rotating said anchor body against return rotation.

* * * * *